United States Patent [19]

Hippely et al.

[11] Patent Number: 4,732,569

[45] Date of Patent: Mar. 22, 1988

[54] TOY VEHICLE LAUNCHER

[75] Inventors: Keith Hippely, Manhattan Beach; George Soulakis, Hermosa Beach, both of Calif.

[73] Assignee: Mattel, Inc., Hawthorne, Calif.

[21] Appl. No.: 882,644

[22] Filed: Jul. 7, 1986

[51] Int. Cl.[4] ..... A63H 29/00

[52] U.S. Cl. ..... 446/430

[58] Field of Search ..... 446/430, 429, 457, 462

[56] References Cited

U.S. PATENT DOCUMENTS

| | | | |
|---|---|---|---|
| 2,788,613 | 4/1957 | Gelfand et al. | 446/429 |
| 3,216,529 | 11/1965 | Lohr | 185/39 |
| 3,548,534 | 12/1970 | Beny et al. . | |
| 3,621,607 | 11/1971 | Morrison et al. . | |
| 3,621,939 | 11/1971 | Hughes . | |
| 3,701,216 | 10/1972 | Smith, III et al. . | |
| 3,789,542 | 2/1974 | Sims et al. . | |
| 3,797,164 | 3/1974 | Glass et al. | 446/430 X |
| 3,877,169 | 4/1975 | Munday et al. . | |
| 3,895,458 | 7/1975 | Lemelson | 446/429 |
| 4,188,748 | 2/1980 | Rich et al. . | |
| 4,267,661 | 5/1981 | Hanson | 446/430 |
| 4,403,440 | 9/1983 | Wulff . | |
| 4,483,096 | 11/1984 | Gabler et al. | 446/430 |
| 4,498,886 | 2/1985 | Goldfarb et al. | 446/202 |
| 4,501,567 | 2/1985 | Cathell | 446/430 |
| 4,534,745 | 8/1985 | Jones et al. | 446/429 X |

FOREIGN PATENT DOCUMENTS

| | | |
|---|---|---|
| 2004654 | 8/1971 | Fed. Rep. of Germany . |
| 165966 | 7/1921 | United Kingdom . |

*Primary Examiner*—Mickey Yu

*Attorney, Agent, or Firm*—Ronald M. Goldman; Melvin A. Klein; Daniel F. Sullivan

[57] ABSTRACT

A toy vehicle launcher used to propel a toy vehicle forward by pulling a flexible rack so that cam portions attached to the rack and launcher operably engage each other bending a flexible support downward in order to release the vehicle. A slider attaches to the front of the toy vehicle and pulls it forward after it is released. The toy vehicle may be easily mounted on top of the launcher by attaching it to horizontal and vertical supports. While in this position, the rear wheels of the vehicle rest on top of and engage wheels rotatably mounted on the launcher. Plates attached to the flexible support help to guide the rack as it engages a gear attached to the wheels mounted on the launcher. The rack rotates these wheels as it is pulled, resulting in the wheels of the toy vehicle being rotated as it is launched forward.

6 Claims, 9 Drawing Figures

FIG. 2
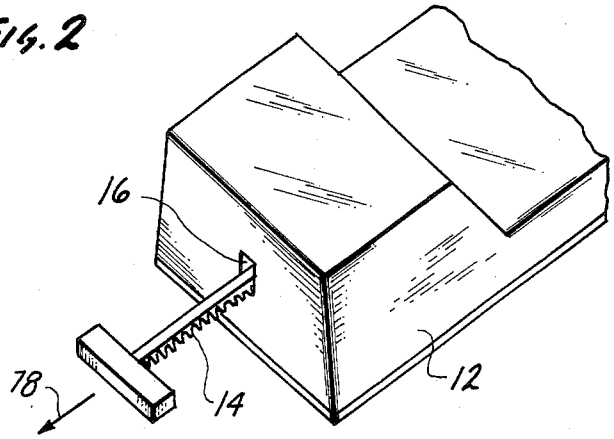
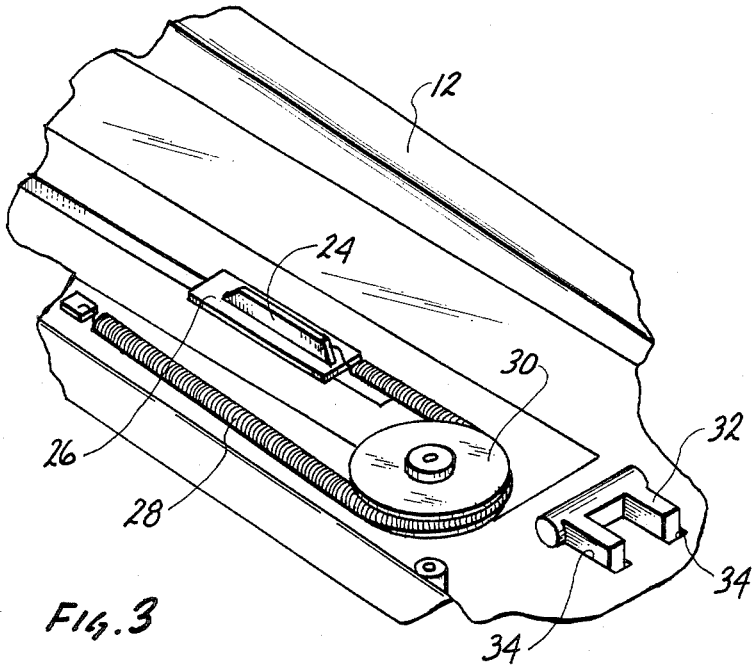
FIG. 3

Fig. 6
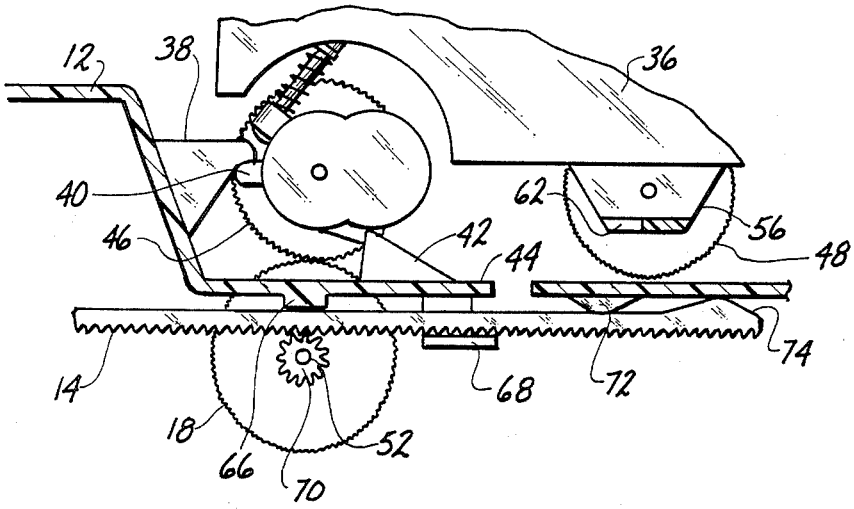
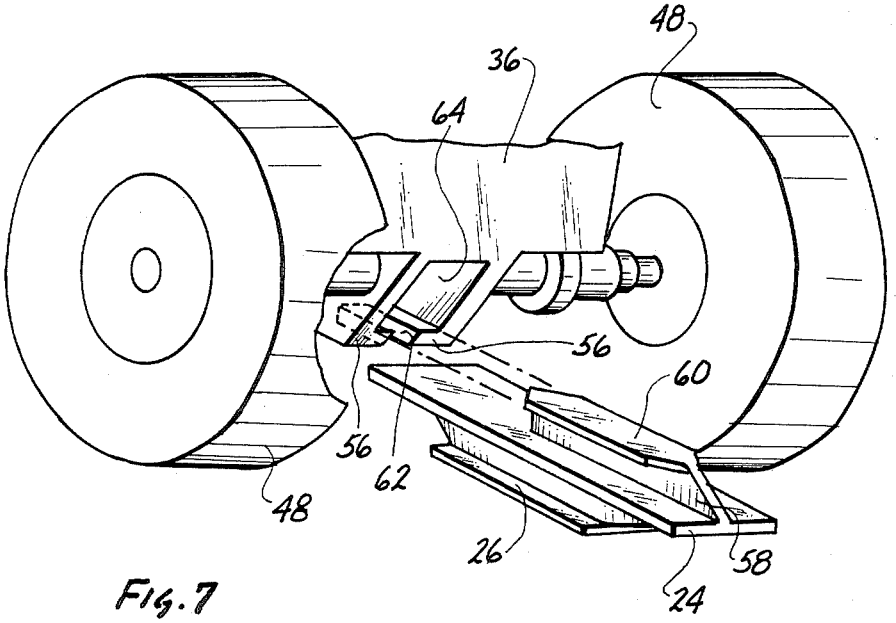
Fig. 7

TOY VEHICLE LAUNCHER

BACKGROUND OF THE INVENTION

The present invention relates generally to toy vehicle launchers and, more particularly, to a launcher which may be used to propel a toy vehicle forward by pulling a flexible rack so that cam portions attached to the rack and launcher operably engage each other bending a flexible support in order to release the toy vehicle.

Various types of launchers have been used in the past for the purpose of allowing a child to propel or launch a toy car forward during play. For example, toy launchers using racks are disclosed in U.S. Pat. Nos. 4,501,567 issued to Cathell on Feb. 26, 1985 and 3,701,216 issued to Smith, III et al on Oct. 31, 1972. Other toy launchers are described in U.S. Pat. Nos. 4,483,096 issued to Gabler et al on Nov. 20, 1984; 4,403,440 issued to Wulff on Sept. 13, 1983; 4,188,748 issued to Rich et al on Feb. 19, 1980; 3,877,169 issued to Munday et al on Apr. 15, 1975; 3,789,542 issued to Sims et al on Feb. 5, 1974; 3,621,607 issued to Morrison et al on Nov. 23, 1971 and 3,548,534 issued to Beny et al on Dec. 22, 1970. German patent No. 2004654 dated Aug. 12, 1971 also shows a toy launcher. Racks are used to energize motors in U.S. Pat. Nos. 3,621,939 issued to Hughes on Nov. 23, 1971 and 3,216,529 issued to Lohr on Nov. 9, 1965. Finally, British Pat. No. 165,966, issued to Mitchell and dated July 11, 1921, discloses a toy car motor which may be wound up by pulling a rack or cord.

None of the above patents discloses a toy vehicle launcher which may be used to first mount a toy vehicle on top of a flexible support and then launch the vehicle by pulling a flexible rack in order that cam portions on the rack and launcher will engage releasing the vehicle. Such a toy launcher may be easily used by a child to propel a variety of different toy cars forward. Accordingly, there is a need in the toy manufacturing arts for a toy vehicle launcher featuring a launching rack used in conjunction with a flexible support to propel a toy vehicle forward.

SUMMARY OF THE INVENTION

It is an object of this invention to provide an improved toy vehicle launcher.

It is another object of this invention to provide an improved toy vehicle launcher having a flexible support which may be used to easily mount a toy vehicle on top of the launcher.

It is still another object of this invention to provide an improved toy vehicle launcher having a launching rack which may be used with a flexible support to propel a toy vehicle forward.

It is still another object of this invention to provide an improved toy vehicle launcher having an adjustable member at one end thereof which may be used to flip launched toy vehicles.

These and other objects and advantages are attained by a toy vehicle launcher used to propel a toy vehicle forward by pulling a flexible rack so that cam portions attached to the rack and launcher operably engage each other bending a flexible support downward in order to release the vehicle. The toy vehicle may be easily mounted on top of the launcher by attaching it to horizontal and vertical supports. While in this position, the rear wheels of the vehicle rest on top of and engage wheels rotatably mounted on the launcher. A slider attaches to the front of the toy vehicle and pulls it forward after the vehicle is released. Plates attached to the flexible support help to guide the rack as it engages a gear attached to the wheels mounted on the launcher. The rack rotates these wheels as it is pulled, resulting in the wheels of the toy vehicle being rotated as it is launched forward.

The various features of the present invention will be best understood, together with further objects and advantages by reference to the following description of the preferred embodiment, taken in connection with the accompanying drawings.

BRIEF DESCRIPTION OF THE DRAWINGS

FIG. 2 is a perspective view of the launcher showing how a launching rack fits through an aperture in the launcher;

FIG. 3 is a perspective view of the top inside portion of the launcher shown in an inverted position taken near the front of the launcher;

FIG. 6 is a partial cross-sectional view taken near the flexible support showing how a toy vehicle may be mounted on the launcher.

FIG. 7 is a perspective view showing how fingers on a toy vehicle engage a slider used for the launcher;

DESCRIPTION OF THE PREFERRED EMBODIMENT

The following specification taken in conjunction with the drawings sets forth the preferred embodiment of the present invention is such a manner that any person skilled in the toy manufacturing arts can use the invention. The embodiment of the invention disclosed herein is the best mode contemplated by the inventors for carrying out their invention in a commerical environment, although it should be understood that various modifications can be accomplished within the parameters of the present invention.

Figure 1:
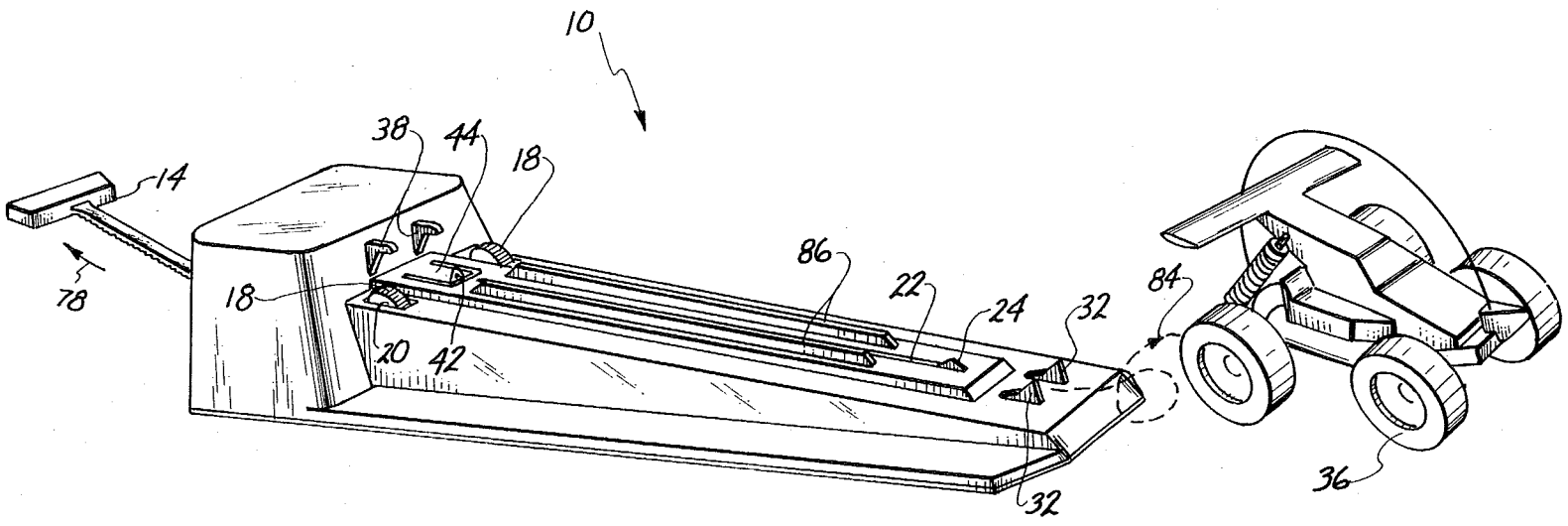
FIG. 1 is a perspective view of the preferred embodiment of the toy vehicle launcher of the present invention.

Referring now to the drawings and particularly to FIGS. 1 and 2, a preferred embodiment of the toy launcher 10 of the present invention is disclosed. The toy launcher 10 has a body portion 12 with a launching rack 14 entering an aperture 16 at the rear end thereof. Two wheels 18 rotatably mounted to the toy launcher 10 pass through apertures 20 at the top of the launcher. The launcher has an elongated slot 22 extending substantially along the length thereof. A slider 24 slidably engages the slot 22 and extends upward past the slot as shown in FIG. 1.

As shown in FIG. 3, flange 26 of the slider 24 slidably engages the top inside surface of the body portion 12 and is biased toward the front of the launcher 10 by a spring 28 wrapped around a pulley-like member 30. One end of the spring 28 is attached to the slider 24 while the other end thereof is attached to the body portion 12. An adjustable member 32 engages apertures 34 near the front of the launcher 10. Member 32 may be coupled to the launcher 10 by any desirable means which would allow the member to be extended above the top surface of the launcher as shown in FIG. 1 or moved inside the launcher below the top surface.

Figure 4:
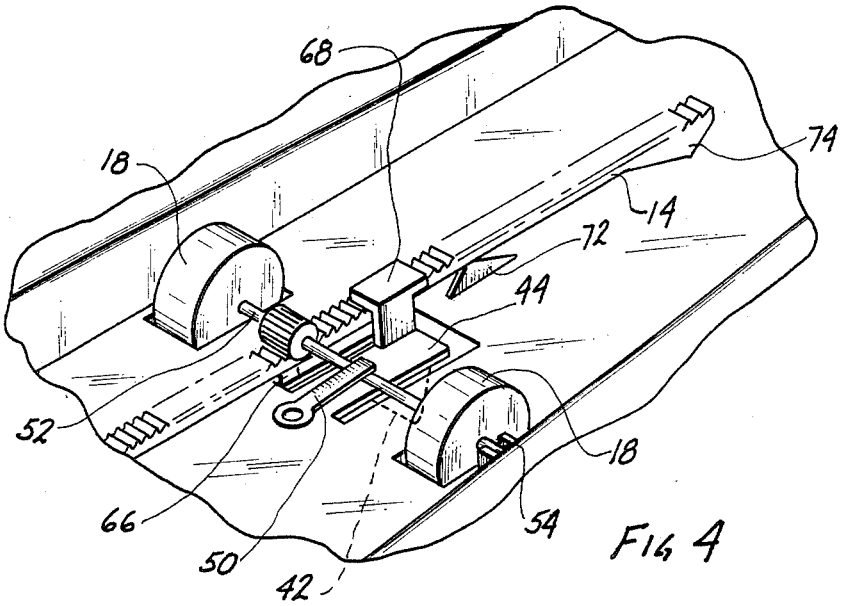
FIG. 4. is a perspective view taken similar to FIG. 3 near a flexible support of the launcher.

A toy vehicle 36 may be mounted to the top of the launcher 10 as shown in FIG. 6. Two horizontal supports 38 preferably engage extensions 40 at the bottom of the toy vehicle 36. In addition, a vertical support 42 attached to a flexible support 44 engages the bottom of the vehicle 36 as shown. While in this position, the rear wheels 46 of the toy vehicle 36 rest on top of and engage the wheels 18 extending through slots 20 (see FIG. 1). The front wheels 48 of the vehicle 36 rest on the top surface of the launcher as shown in FIG. 6. As best shown in FIG. 4, the wheels 18 are held in place by a leaf spring 50 attached to the launcher 10. The wheels 18 are attached to an axle 52. The ends of the axle 52 fit into channels 54 attached to the launcher 10. As such, the wheels 18 may be pushed downward against the force of the leaf spring 50 to facilitate mounting the toy vehicle 36 on the launcher 10.

Figure 9:
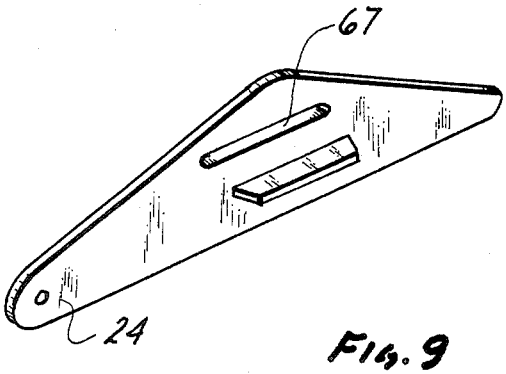
FIG. 9 is a perspective view of another embodiment of the slider used for the launcher.

The toy vehicle 36 is attached to the slider 24 by fingers 56 attached to the bottom front end of the vehicle. Web 58 and flange 60 of the slider 24 operably engage apertures 62 and 64, respectively, formed by the fingers 56. Another embodiment of the slider 24 is shown in FIG. 9. Grooves 67 are provided in the slider 24 for engaging the fingers 56. In such case, aperture 62 would extend through the length of the fingers 56. Any desired variation of the slider 24 may be used.

Figure 5:
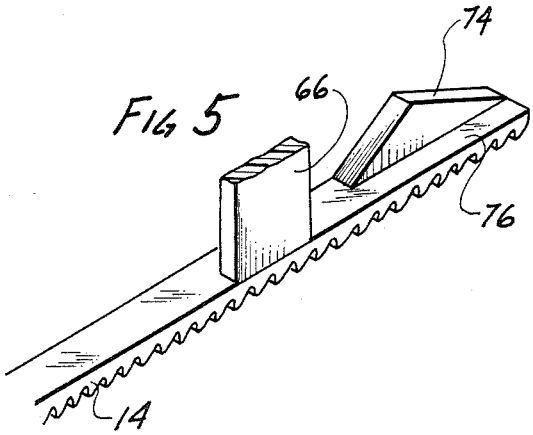
FIG. 5 is an enlarged detailed view of the launching rack showing how a guide plate engages the rack.

As best shown in FIGS. 4 and 6, the flexible support 44 has a guide plate 66 and L-shaped plate 68 attached to it. The launching rack 14 is inserted through aperture 16 in the launcher 10 and between guide plate 66 and a gear 70 attached to axle 52 so that the teeth of the rack engage the teeth of the gear. The rack 14 is also slid on top of plate 68 and past a cam portion 72 attached to the top inside surface of the launcher 10. A cam portion 74 is also attached to the end of the rack 14. Note that guide plate 66 is free to slide on surface 76 of the rack 14 as shown in FIG. 5.

Figure 8:
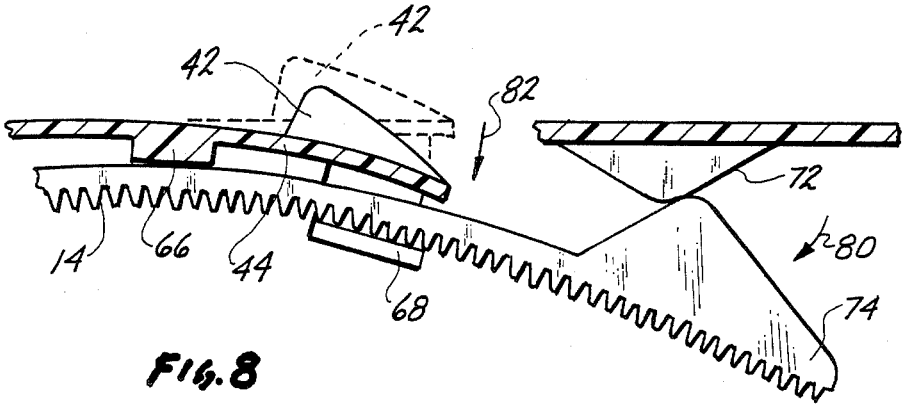
FIG. 8 is a partial cross-sectional view showing how cam portions of the rack and launcher are used to rotate the flexible support downward.

A toy vehicle 36 may be launched by first attaching the slider 24 to fingers 56 and pulling the slider toward supports 38 and 42 until the vehicle is mounted on top of the launcher 10 as shown in FIG. 6. The rack 14 is then positioned as shown in FIG. 6. The rack 14 is then pulled in the direction of arrow 78 shown in FIGS. 1 and 2. As the rack 14 moves cam portions 72 and 74 come into contact with each other as shown in FIG. 8. This causes the rack 14 and flexible support 44 to move in accordance with arrows 80 and 82, respectively. As flexible support 44 moves, vertical support 42 also moves downward in the direction of arrow 82 releasing the bottom of the toy vehicle 36. As the vehicle 36 is released, the slider 24 pulls the vehicle forward launching it past the front of the launcher. Since the teeth of the rack 14 engage the teeth of gear 70, wheels 18 rotate as the rack 14 is pulled backward. Wheels 18 then cause the rear wheels 46 of the vehicle 36 to rotate as it is pulled forward. This provides the necessary momentum to energize a flywheel motor of the vehicle 36.

If the adjustable member 32 is positioned as shown in FIG. 1, then the vehicle 36 will flip as indicated by dotted arrow 84. Upwardly extending edges 86 are attched to the top of the launcher 10 and are used to guide the toy vehicle 10 as it is being launched forward.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy vehicle launcher comprising:

a body portion having an elongated slot therein;

wheels attached to an axle rotatably mounted on said body portion, said axle having a gear attached thereto;

slider means operably engaging said elongated slot for pulling a toy vehicle forward;

support means for releasably mounting said toy vehicle on top of said body portion, said support means including a flexible support attached to said body portion;

a rack passing through an aperture in said body portion and operably engaging said axle; and cam means for bending said flexible support as said rack is pulled.

2. A toy vehicle launcher comprising:

a body portion having an elongated slot therein;

wheels attached to an axle rotatably mounted on said body portion, said axle having a gear attached thereto;

a slider slidably engaging said elongated slot;

spring means for biasing said slider toward the front of said body portion;

support means for releasably mounting a toy vehicle on top of said body portion; and a rack passing through an aperture in said body portion and operably engaging said gear attached to said axle, said rack and said body portion having cam portions attached thereto.

3. The toy vehicle launcher to claim 2 further comprising an adjustable member coupled to said body portion near the front end thereof.

4. The toy vehicle launcher of claim 2 wherein said support means includes horizontal supports attached to said body portion and a vertical support attached to a flexible support, said flexible support being attached to said body portion.

5. The toy vehicle launcher of claim 4 wherein said flexible member has a generally L-shaped plate and a guide plate attached thereto, said guide plate keeping said rack engaged to said gear.

6. The toy vehicle launcher of claim 5 wherein said body portion has upwardly extending edges attached to the top surface thereof.

* * * * *